United States Patent [19]

Bruder et al.

[11] Patent Number: 4,459,028

[45] Date of Patent: Jul. 10, 1984

[54] APPARATUS FOR WEIGHING AND BLENDING FLUENT MATERIALS

[75] Inventors: Stephen Bruder, Budd Lake; Philip Higby, Towaco; Edgar Roth, Dumont, all of N.J.

[73] Assignee: Lee Heydenreich, Essex Falls, N.J.

[21] Appl. No.: 469,427

[22] Filed: Feb. 24, 1983

[51] Int. Cl.[3] ..... B01F 15/02

[52] U.S. Cl. ..... 366/141; 141/83; 177/70; 366/156; 366/181

[58] Field of Search ..... 366/141, 156, 162, 181, 366/18; 141/83; 222/77; 177/25, 59, 70

[56] References Cited

U.S. PATENT DOCUMENTS

| | | | |
|---|---|---|---|
| 808,599 | 12/1905 | Crichfield | 366/18 |
| 2,089,534 | 8/1937 | Carlson | 177/59 X |
| 2,530,501 | 11/1950 | Avril | 366/141 X |
| 2,594,975 | 4/1952 | Mytling | 366/141 |
| 3,967,815 | 7/1976 | Backus et al. | 366/141 X |
| 4,206,822 | 6/1980 | Mazzucchelli | 177/70 X |
| 4,313,507 | 2/1982 | Hays | 177/25 X |
| 4,344,492 | 8/1982 | Hirano | 177/25 |

*Primary Examiner*—Philip R. Coe
*Attorney, Agent, or Firm*—Bernard J. Murphy

[57] ABSTRACT

The apparatus has a plurality of fluent-material-receiving chambers arrayed about a central, vertical pipe, and each chamber has a load beam extending therefrom. Gusset-type brackets, projecting from the pipe have slotted limbs through which the load beams pass, and opposite end of the load beams are coupled to load cells. Also, steel flexures are interposed between the limbs and the load beams pivotably to support the load beams thereon. Each beam has a counterweight fixed thereto, such counterweights being of weights which counterbalance the summed weight of its associated chamber and such components which are fixed to said chamber. Hence, weights of fluent materials introduced into the chambers can be directly read without there being a need to discount the chamber and components weight. Auger-type conveyors are provided for conducting fluent materials from each of the chambers to a blending tank. The latter has a mixing wand therein which is motor-driven to thoroughly mix the tank contents.

8 Claims, 3 Drawing Figures

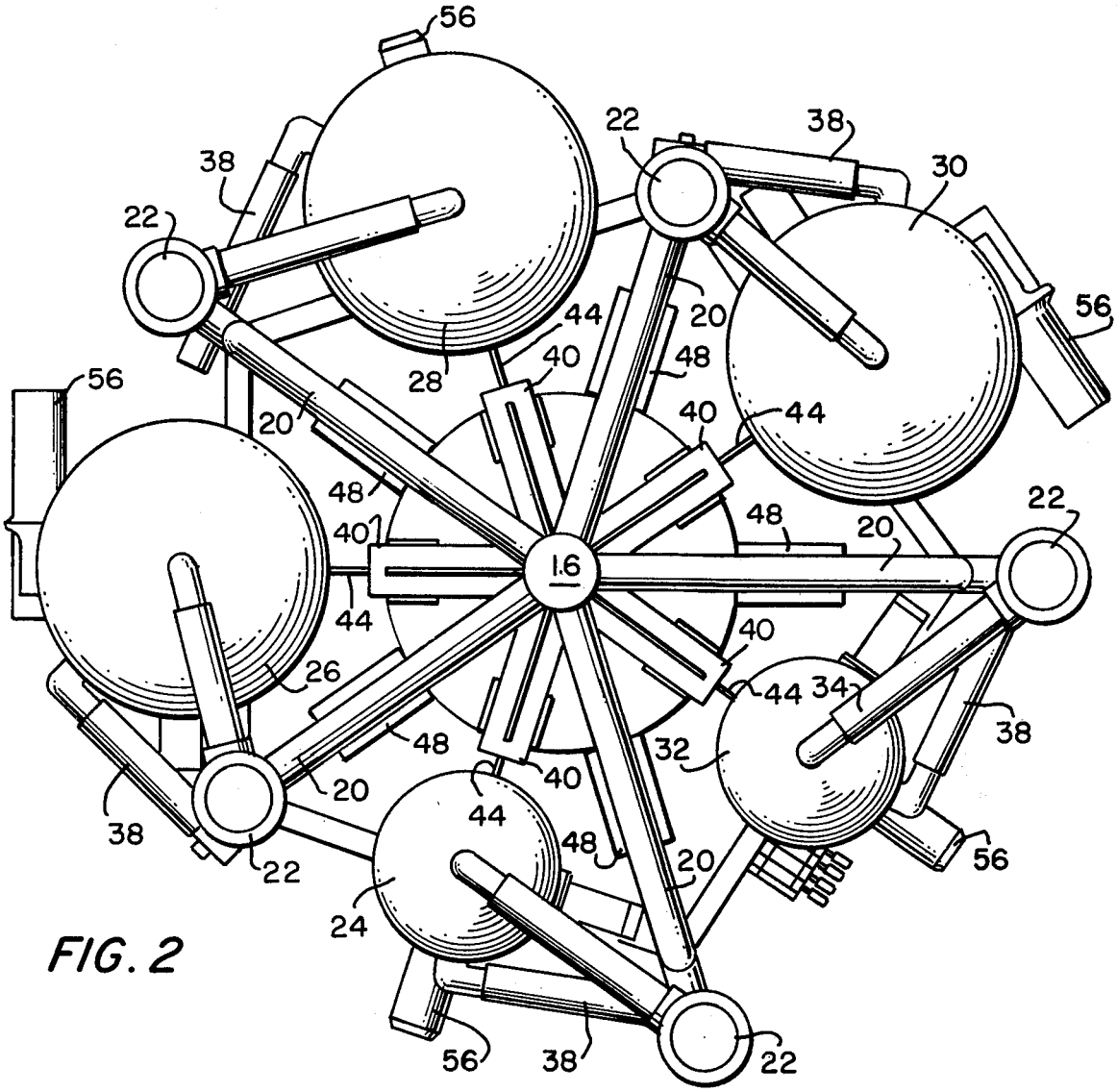
FIG. 2
FIG. 3
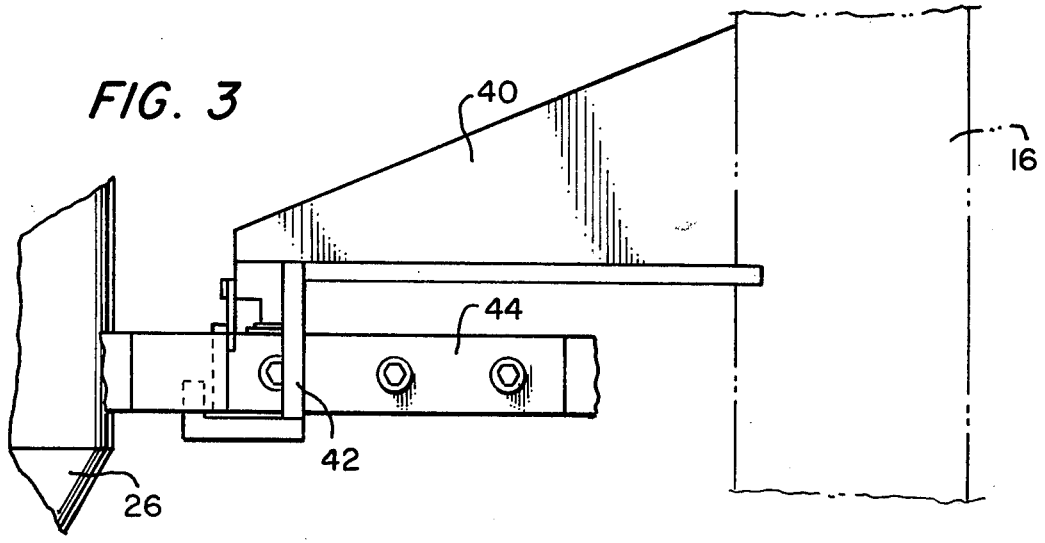

APPARATUS FOR WEIGHING AND BLENDING FLUENT MATERIALS

This invention pertains to apparatus for weighing and blending fluent materials, and in particular to a novel, compact and integrated loss-weight apparatus of the aforesaid type having a blending tank.

Prior art apparatus of the type to which the invention pertains are rather complex structures having frames and distinct conduits and pipes for conducting necessary vacuum pressures, and means for assaying the weights of fluent materials in several chambers, while having to discount chamber weights.

It is an object of this invention to disclose an apparatus for weighing and blending fluent materials in which the frame thereof serves as a support and as a means for introducing vacuum pressure to a plurality of fluent-material-receiving chambers. It is further an object of this invention to set forth an apparatus for weighing and blending fluent materials in which the weight of the receiving chambers and the components associated and coupled thereto is counterbalanced, whereby direct readings of chamber contents can be taken and monitored.

It is particularly an object of this invention to disclose an apparatus for weighing and blending fluent materials, comprising means defining a support frame; a plurality of chambers for receiving fluent materials; means coupling said chambers to said frame; a pipe having a passage therewithin; said chambers being radially arrayed about said pipe; and conduits communicating said passage with said chambers; wherein said coupling means comprises load beams; each of said chambers has one of said load beams fixed, at a first end thereof, to said chamber, said load beam extending from such chamber perpendicularly; each of said load beams penetrating said pipe; second ends of said load beams being fixed to load cells; said load cells being fixed to said frame; each of said load beams having prescribed counterweights secured thereto adjacent said second ends thereof; means coupled to said frame defining a blending tank; and means for communicating fluent material from each of said chambers to said blending tank.

Further objects of this invention, as well as the novel features thereof, will become more apparent, by reference to the following description taken in conjunction with the accompanying figures, in which:

FIG. 2 is a plan view of the embodiment of FIG. 1; and

FIG. 3 is an enlarged detail of the pivot mounting of one of the load beams.

Figure 1:
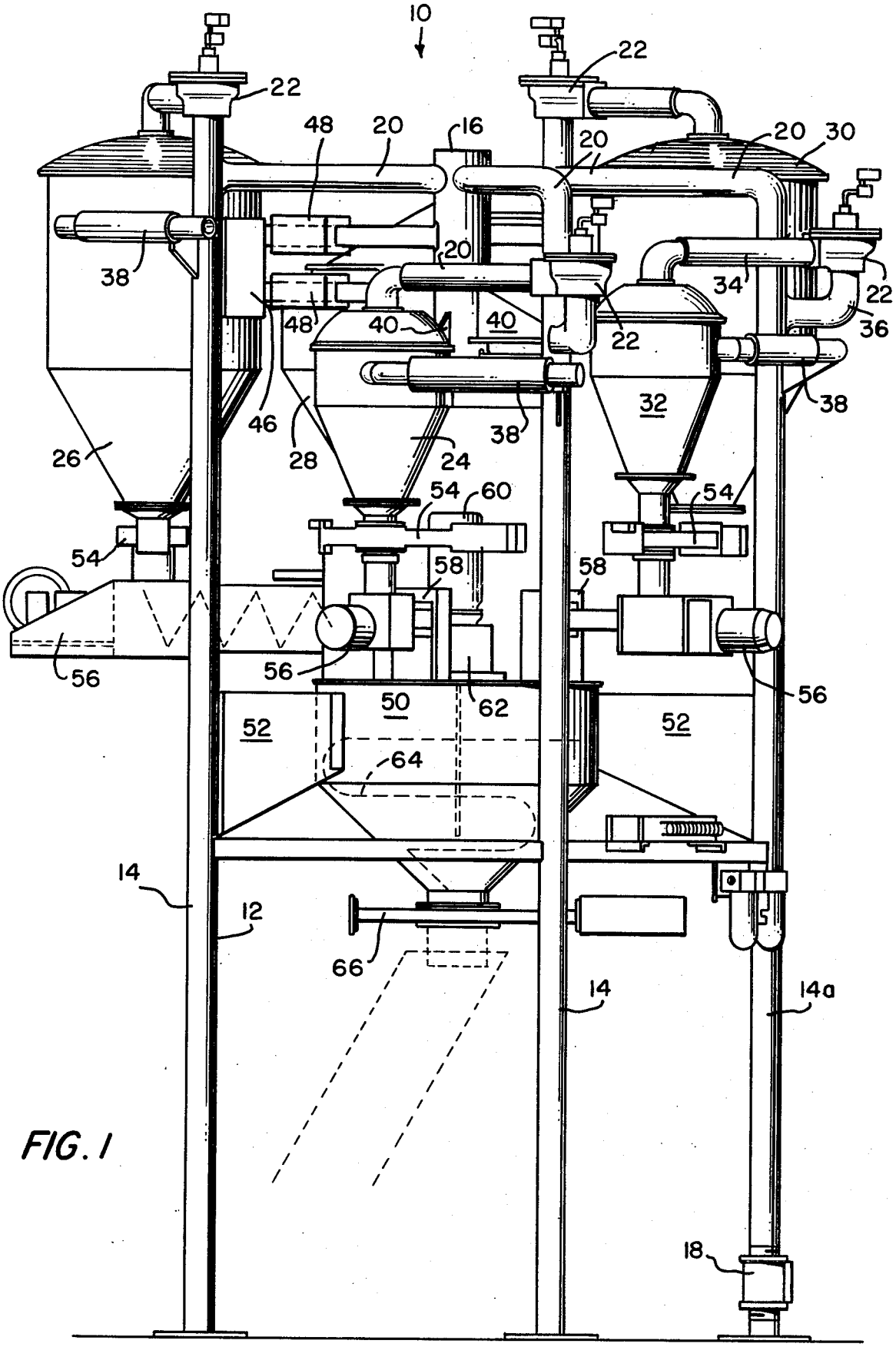
FIG. 1 is a side elevational view of an embodiment of the novel apparatus for weighing and blending fluent materials.

As shown in the figures, the novel apparatus for weighing and blending fluent materials 10, according to an embodiment thereof, comprises a frame 12 formed of tubular members 14 and 14*a*. The members 14 and 14*a* are radially arranged about a central pipe 16. The one member 14*a* has a fitting 18, adjacent the lowermost end thereof, for connecting thereto a source of vacuum pressure, and the uppermost end thereof describes a dog-leg turn in toward the pipe 16 and opens into the latter. Four vacuum conduits 20, opening into the same pipe 16, radiate therefrom to vacuum control valves 22, and turn, then, generally inwardly to open into four vacuum weighing chambers 24, 26, 28 and 30. A fifth vacuum weighing chamber 32 has a conduit 34 communicating therewith which, through a valve 22 and a bight portion 36 of the conduit 34, communicates with member 14*a*. By these means, the chambers 24, 26, 28, 30 and 32 have a vacuum pressure induced therein, to cause fluent material to be ingested thereinto. Each of the aforesaid chambers has a fluent material inlet hose 38 by means of which, in response to the vacuum pressure, such material enters the chambers.

The central pipe 16 has five gusset-type brackets 40 fixed thereto, which project therefrom, to provide bearing support for the chambers 24, 26, 28, 30 and 32. Each bracket 40 has a depending limb 42 which is slotted therethrough. The slotted limbs 42 receive load beams 44 through the slots thereof. One end of each beam 44 is fixed to, and projects perpendicularly from a given one of the chambers. The opposite ends of the beams 44 are coupled to load cells 46. Also, adjacent the opposite ends of the beams 44 are fixed counterweights 48; the purpose of the latter is explained in the ensuing text.

Within the radial center of the apparatus 10, below the chambers 24, 26, 28, 30 and 32 is a blending tank 50. Tank 50 is secured in place by a plurality of gussets 52 which are fastened, at opposite sides thereof, to the tank 50 and the members 14 and 14*a* of the frame 12. Each of the aforesaid chambers has, in the lowermost end thereof an aperture controlled by a gating shutoff valve 54. Each valve opens onto an auger-type conveyor assembly 56, and each of the assemblies conveys fluent material, from its associated chamber, to a shroud 58 carried by the tank 50.

Mounted atop the tank 50 are a motor 60 and gear reducer 62. The latter power a mixer element 64 confined within the tank. Tank 50 also has a discharge aperture in the lowermost end thereof controlled by a gating dump valve 66.

It is to be noted that the load beams 44 penetrate the pipe 16, even though the latter comprises part of the vacuum communication. This is arranged by having the hollow of the pipe 16 closed off, below the conduits 20 and 34, and above the first penetrating load beam 44. This novel use of structure is shown in the dual use of member 14*a* as a support leg and as the vacuum pressure inlet to the apparatus. Similarly, same piping serves as members 14 and as vacuum conduits for supplying the vacuum to the chambers. Where the load beams penetrate the central pipe 16, oversized slots are provided—this to allow for slight pivotal movement of the load beams 44. In between the limbs 42 and the load beams 44 which pass therethrough, are steel flexure points for a pivotal support of the beams.

Each chamber 24, 26, 28, 30 and 32, together with the aforementioned components pendent therefrom, comprises a given weight. The counterweights 48 are so selected that they wholly counterbalance such given weights. When the chambers have no fluent materials therein, each load cell sees a zero weight. Upon fluent materials being conducted to the chambers, the load cells reflect a loading which exactly corresponds to the weight of the chamber-received materials, only. Delivery from each chamber, then, is a measure of the amount of indicated weight which has been lost by the chamber. This efficient arrangement makes it possible for the full range of load cell sensing to be employed only for gauging materials weight.

As can be appreciated, the apparatus 10 can be used with two of the chambers, or three, or four, or all five thereof. The admittance of fluent materials into the chambers, and the controlled discharge thereof into the blending tank, the amount of mixing in the blending tank 50, and the controlled discharge of it, are all subject to selectively individual electrical controls, or may be supervised by a micro-processor-controlled operator's panel. Such an operator's control panel is the proprietary matter of Foremost Machine Builders, Inc., of 23 Spielman Road (P.O. Box 644) Fairfield, N.J. 07006, and is available from the firm. As noted, the aforementioned Foremost Machine Builders' micro-processor-controlled operator's panel, is proprietary. However, the latter comprises an assembly which monitors the loss-weight delivery of each and every chamber, and displays the quantities of such deliveries. Further, it controls the vacuum input to the chambers, whereby it supervises the fluent materials ingestion by each of the chambers, and limits the duration of mixing in the blending tank 50. The Foremost Machine Builders' control station automatically records the starting weights of fluent materials in the chambers, and meters out, from the chambers, predetermined and selective quantities of each. Vacuum loading, metering discharge from the chambers, and mixing in the blending tank 50 are capable of overlapped performance, with the aforesaid proprietary control station and, as a consequence, a maximum use of the apparatus 10 can be realized. Finally, the Foremost panel displays an "accumulation inventory" of the sum of metered-out material. While we have described our invention in connection with a specific embodiment thereof, it is to be clearly understood that this is done on y by way of example, and not as a limitation to the scope of our invention as set forth in the objects thereof, and in the appended claims.

We claim:

1. Apparatus for weighing and blending fluent materials, comprising:

means defining a support frame;

a plurality of chambers for receiving fluent materials;

means coupling said chambers to said frame;

a pipe having a passage therewithin;

said chambers being radially arrayed about said pipe; and conduits communicating said passage with said chambers; wherein said coupling means comprises load beams;

each of said chambers has one of said load beams fixed, at a first end of each beam, to said chamber, said load beam extending from such chamber perpendicularly;

each of said load beams penetrating said pipe;

second ends of said load beams being fixed to load cells;

said load cells being fixed to said frame;

each of said load beams having prescribed counterweights secured thereto adjacent said second ends thereof;

means coupled to said frame defining a blending tank; and means for communicating fluent material from each of said chambers to said blending tank.

2. Apparatus for weighing and blending fluent materials, according to claim 1, wherein:

said pipe has a plurality of gusset-type brackets fixed thereto and extending perpendicularly therefrom;

each of said brackets has a depending limb with a slot formed therethrough;

said load beams traverse said slots; and knife-edge bearings are interposed between said load beams and said limbs, pivotably to support said load beams thereon.

3. Apparatus for weighing and blending fluent materials, according to claim 1, wherein:

said communicating means comprises conveyors opening at a first end thereof into one of said chambers, and opening at an opposite end thereof into said blending tank.

4. Apparatus for weighing and blending fluent materials, according to claim 3, wherein:

each of said chambers has a lowermost opening which confronts said first end of the conveyor associated therewith; and valving means is interposed between said lowermost opening of each said chamber and said first end of said conveyors.

5. Apparatus for weighing and blending fluent materials, according to claim 4, wherein:

said conveyors are motor-driven augers.

6. Apparatus for weighing and blending fluent materials, according to claim 1, wherein:

said frame has a plurality of vertical members;

one of said members is hollow;

said one member has an opening, adjacent one end thereof, for coupling thereto a source of vacuum pressure; and the end of said one member, opposite said one end, is in fluid communication with said passage in said pipe.

7. Apparatus for weighing and blending fluent materials, according to claim 1, wherein:

each of said chambers has an inlet port formed therein; and a fluent material feed conduit is through-coupled with each of said inlet ports of said chambers.

8. Apparatus for weighing and blending fluent materials, according to claim 1, wherein:

each counterweight has a weight which counterbalances the weight of the chamber with which it is associated and all components pendent from and attached to such chamber.

* * * * *